US006086959A

United States Patent [19]

Inspektor

[11] Patent Number: 6,086,959

[45] **Date of Patent: *Jul. 11, 2000**

[54] BORON AND NITROGEN CONTAINING COATING AND METHOD FOR MAKING

[75] Inventor: Aharon Inspektor, Pittsburgh, Pa.

[73] Assignee: Kennametal Inc., Latrobe, Pa.

[ * ] Notice: This patent is subject to a terminal disclaimer.

[21] Appl. No.: 09/208,157

[22] Filed: Dec. 9, 1998

Related U.S. Application Data

[62] Division of application No. 08/627,515, Apr. 4, 1996, Pat. No. 5,948,541.

[51] Int. Cl.[7] ..... C23C 14/00

[52] U.S. Cl. ..... 427/419.7; 204/192.1; 204/192.11; 204/298.01; 204/298.02; 204/298.05; 427/255.1; 427/255.2; 427/255.7; 427/457; 427/470; 427/530

[58] Field of Search ..... 427/402, 419.1, 427/419.7, 427, 255.1, 255.2, 457, 470, 530; 204/192.1, 192.11, 298.01, 298.02, 298.05

[56] References Cited

U.S. PATENT DOCUMENTS

| | | |
|---|---|---|
| 3,767,371 | 10/1973 | Wentorf et al. . |
| 4,035,541 | 7/1977 | Smith et al. . |
| 4,237,184 | 12/1980 | Gonseth et al. . |
| 4,282,289 | 8/1981 | Kullander et al. . |
| 4,399,168 | 8/1983 | Kullander et al. . |

(List continued on next page.)

FOREIGN PATENT DOCUMENTS

| | | |
|---|---|---|
| 0179582 | 4/1986 | European Pat. Off. . |
| 476825 | 3/1992 | European Pat. Off. . |
| 0504959 | 9/1992 | European Pat. Off. . |
| 598762 | 6/1994 | European Pat. Off. . |
| 4126851 | 2/1993 | Germany . |
| 4407274 | 3/1995 | Germany . |
| 60-234961 | 5/1984 | Japan . |
| 60-243273 | 5/1984 | Japan . |
| 62058050 | 9/1985 | Japan . |
| 63026349 | 7/1986 | Japan . |
| 02025562 | 7/1988 | Japan . |
| 4124272 | 9/1990 | Japan . |
| 4168263 | 10/1990 | Japan . |
| 91013305 | 2/1991 | Japan . |
| 4337064 | 5/1991 | Japan . |
| 3260054 | 11/1991 | Japan . |
| 7018415 | 6/1993 | Japan . |
| 93054594 | 7/1993 | Japan . |
| 5286789 | 11/1993 | Japan . |
| 5-161280 | 3/1994 | Japan . |
| 9635820 | 11/1996 | WIPO . |

OTHER PUBLICATIONS

Jindal et al., "Adhesion Measurements of Chemically Vapor Deposited and Physically Vapor Deposited Hard Coatings on WC–Co Substrates," Thin Solid Films, 154 (1987) pp. 361–375.

Badzian, "Superhard Material Comparable in Hardness to Diamond," Appl. Physics Letter 53(25) 1988, pp. 2495–2498.

Holleck et al., "Multilayer PVD Coatings for Wear Protection," Surface and Coatings Technology, 76–77 (1995), pp. 328–336.

(List continued on next page.)

*Primary Examiner*—Archene Turner
*Attorney, Agent, or Firm*—John J. Prizzi

[57] ABSTRACT

A coating scheme comprising a boron and nitrogen containing layer that satisfactorily adheres to a substrate is disclosed. The satisfactorily adherent coating scheme comprises a base layer, a first intermediate layer, a second intermediate layer and the boron and nitrogen containing layer. The coating scheme is compatible with tooling for drilling, turning, milling, and/or forming hard, difficult to cut materials. The coating scheme has been applied to cutting inserts comprised of cermets or ceramics using PVD techniques. The boron and nitrogen layer preferably comprises boron nitride and, more preferably, cubic boron nitride.

40 Claims, 6 Drawing Sheets

U.S. PATENT DOCUMENTS

| | | | |
|---|---|---|---|
| 4,619,865 | 10/1986 | Keem et al. . | |
| 4,643,951 | 2/1987 | Keem et al. . | |
| 4,717,632 | 1/1988 | Keem et al. | 428/698 |
| 4,724,169 | 2/1988 | Keem et al. . | |
| 4,731,303 | 3/1988 | Hirano et al. . | |
| 4,807,402 | 2/1989 | Rai . | |
| 4,892,791 | 1/1990 | Watanabe et al. . | |
| 4,919,773 | 4/1990 | Naik | 404/38.4 |
| 4,965,140 | 10/1990 | Sarin . | |
| 5,053,245 | 10/1991 | Kiyama et al. . | |
| 5,096,740 | 3/1992 | Nakagama et al. . | |
| 5,137,772 | 8/1992 | Watanabe et al. . | |
| 5,208,079 | 5/1993 | Fukushima et al. . | |
| 5,223,337 | 6/1993 | Van Den Berg et al. . | |
| 5,249,554 | 10/1993 | Tamor et al. | 428/408 |
| 5,266,388 | 11/1993 | Santhanam et al. | 428/212 |
| 5,310,603 | 5/1994 | Fukuda et al. . | |
| 5,330,611 | 7/1994 | Doll | 117/105 |
| 5,356,727 | 10/1994 | Grenie et al. . | |
| 5,372,873 | 12/1994 | Yoshimura et al. . | |
| 5,374,471 | 12/1994 | Yoshimura et al. . | |
| 5,389,445 | 2/1995 | Makowiecki et al. . | |
| 5,389,587 | 2/1995 | Nakashima et al. . | |
| 5,398,639 | 3/1995 | Doll et al. . | |
| 5,433,988 | 7/1995 | Fukuda et al. . | |
| 5,436,036 | 7/1995 | Shiomi et al. . | |
| 5,441,817 | 8/1995 | Rai . | |
| 5,483,920 | 1/1996 | Pryor . | |
| 5,491,002 | 2/1996 | Slutz . | |
| 5,503,913 | 4/1996 | Konig et al. . | |
| 5,618,509 | 4/1997 | Shioi et al. | 423/290 |
| 5,633,214 | 5/1997 | Nishio et al. | 501/96.4 |
| 5,639,285 | 6/1997 | Yao et al. | 51/307 |
| 5,639,551 | 6/1997 | Ong et al. | 428/408 |
| 5,670,252 | 9/1997 | Makowiecki et al. | 428/336 |
| 5,691,260 | 11/1997 | Suzuki et al. | 501/96 |

OTHER PUBLICATIONS

Chemical Abstracts, vol. 121, No. 2, p. 459, Jul. 4, 1994.

Kessler et al., "Laser Pulse Vapour Deposition of Polycrystalline Wurtzite–type BN," Thin Solid Films, 147 (1987), L45–L50.

DeVries, Cubic Boron Nitride: Handbook of Properties (Jun. 1972) pp. 1–17.

Peytany et al., "Chemical Vapor Deposition of Titanium Boronitride" *High Temperatures–High Pressures*, vol. 10 (1978) pp. 341–345.

Satou & Fujismoto "Formation of Cubic Boron Nitride Films by Boron Evaporation and Nitrogen Ion Beam Bombardment" *Japanese Journal of Applied Physics*, vol. 22, No. 3 (Mar. 1983), pp. L171–L172.

Goranchev et al., "Compressive Stress of Thin Cubic BN Films Prepared by R.F. Reactive Sputering on R.F. Biased Substrates", *Thin Solid Films*, 149 (1987) pp. L77–L80.

Arya et al., "Preparation, Properties and Applications of Boron Nitride Thin Films", *Thin Solid Films*, 157 (1988) pp. 267–282.

Andoh et al., "On the Formation of BN Films By Ion Beam and Vapor Deposition", *Nuclear Instruments and Method in Physics Research*, B33 (1988) pp. 678–680.

Inagawa et al. "Structure and Properties of c–BN Film Deposited by Activated Reactive Evaporation with a Gas Activation Nozzle", *Surface and Coatings Technology*, 39/40 (1989) pp. 253–264.

Mitterer et al. "Sputter Deposition of Ultrahard Coatings Within the System Ti–B–C–N", *Surface and Coating Technology*, 41 (1990) pp. 351–363.

Mieno et al. "Preparation of Cubic Boron Nitride Films by RF Sputtering", *Japanese Journal of Applied Physics*, vol. 29, No. 7 (Jul. 1990) pp. L1175–1177.

Ikeda et al. "Formation of Cubic Boron Nitride Films by Arc–Like Plasma–Enhanced Ion Plating Method", *J. Vac. Sci. Technol.*, A8 (4), (Jul./Aug. 1990) pp. 3168–3174.

Montasser et al. "A Promising Boron–Carbon–Nitrogen Thin Film", *Materials Science Forum*, vols. 54 and 55 (1990), pp. 295–312.

Karnezos "Boron–Nitrogen–Hydrogen Thin Films", *Materials Science Forum*, vols. 54 and 55 (1990), pp. 261–276.

Ikeda et al. "Formation and Characterization of Cubic Boron Nitride Films by an Arc–Like Plasma–Enhanced Ion Plating Method", *Surface and Coatings Technology*, 50 (1991), pp. 33–39.

Herr et al. "Fundamental Properties and Wear Resistance of R.F. –Sputtered $TiB_2$ and Ti(B,N) Coating", *Material Science and Engineering*, A140 (1991) pp. 616–624.

Aromaa et al. "A Comparative Study of the Corrosion Performance of TiN, Ti (B,N) and Ti, Al) N Coatings Produced by Physical Vapour Deposition Methods", *Materials Science and Engineering*, A140 (1991) pp. 722–726.

Doll et al. "Growth and Characterization of Epitaxial Cubic Boron Nitride Films on Silicon", *Physical Review B*, (Mar. 15, 1991–l) pp. 6816–6819.

Edgar, "Prospects for Device Implementation of Wide Band Gap Semiconductors", *Journal of Materials Research*, vol. 7, No. 1 (Jan. 1992) pp. 235–252.

Ikeda, "Cubic Boron Nitride Films Synthesized by Low–Energy Ion Beam–Enhanced Vapor Deposition", *American Institute of Physics–Appl. Phys. Lett.* 61(7) (Aug. 17, 1992) pp. 786–788.

Kester et al., "Phase Control of Cubic Boron Nitride Thin Films", *American Institute of Physics—J. Appl. Phys.* 72 (2), (Jul. 15, 1992) pp. 504–513.

Wada et al. "Formation of cBN Films by Ion Beam Assisted Deposition", *J. Vac. Sci. Technol. A*, vol. 10, No. 3 (May/Jun. 1992) pp. 515–520.

Stovicek, "Hard–Part Turning–Eliminates Grinding, Improves Quality", *Tooling & Production*, vol. 57, No. 11 (Feb. 1992), pp. 25–26.

Noaker, "Hard Facts on Hard Turning", *Manufacturing Engineering*, vol. 108, No. 2 (Feb. 1992) pp. 43–46.

Matthes et al."Tribological Properties and Wear Behaviour of Sputtered Titanium–Based Hard Coatings Under Sheet–Metal–Forming Conditions", *Materials Science and Engineering*, A140 (1991).

Nishiyama et al., "The Synthesis and Properties of BN Films Prepared by Ion Irradiation and Vapor Deposition", *Nuclear Instruments & Methods in Physics Research*, vol. BBO/B1, Part III (Jun. (III) 1993) pp. 1484–1488, North–Holland.

Sueda "Fundamental Research on the Deposition of Cubic Boron Nitride Films on Curved Substrates by Ion–Beam–Assisted Vapor Deposition", *Thin Solid Films*, 228 (1993) pp. 97–99.

Stovicek "Turning to Hard–Part Turning" *Tooling & Production Mazazine*, (Jan. 1993) pp. 31–33.

Kennametal Advertisement.

Brookes, "Tools on the Cutting Edge", *American Machinist*, (Dec. 1993), pp. 30–33.

Gissler, "Preparation and Characterization of Cubic Boron Nitride and Metal Boron Nitride Films", *Surface and Interface Analysis*, vol. 22 (1994), pp. 139–144.

Ong et al. "Deposition of Cubic BN on Diamond Interlayers", *NASA Tech Brief*, vol. 18, No. 8 (Aug. 1994) Item #74.

Riedel, "Novel Ultrahard Materials" *Advanced Materials*, 6 No. 7/8 (1994) pp. 549–560.

Zhang et al., "Deposition of High Quality Cubic Boron Nitride Films on Nickel Substrates", *American Institute of Physics–Appl. Phys. Lett*. 65 (8) (Aug. 22, 1994) pp. 971–973.

Kroczynski et al., "Ion Beam–Assisted Deposition of Boron Nitride From a Condensed Layer of Diborane and Ammonia at 78K", *Materials Research Society, Symposium Proceedings*, vol. 316 (1994) pp. 869–873.

Ichiki, "Growth of Cubic Boron Nitride Films by Low–Pressure Inductively Coupled Plasma Enhanced Chemical Vapor Deposition", *Japanese Journal Appl. Phys.*, vol. 33, Part 1, No. 7B (Jul. 1994) pp. 4385–4388.

Yarbrough, "Thermodynamics of c–BN?", *Materials Research Lab*. Penn State (Oct. 1994).

Inspektor et al., "Superhard Coating for Metal Cutting Application", *Surface and Coatings Technology*, 68/69 (1994) pp. 359–368.

Song et al., "Textured Growth of Cubic Boron Nitride Film on Nickel Substrates", *American Institute of Physics, Appl. Phys. Lett*. 65 (Nov. 21, 1994) pp. 2669–2671.

Vasilash, "The Superhard Coatings: More Than Meets the Eye" *Production*, (Dec. 1995) pp. 52–54.

Kuhr et al., "Deposition of Cubic Boron Nitride with an Inductively Coupled Plasma", *Surface and Coating Technology*, 74–75 (1995) pp. 806–812.

Noaker, "Hard Turning Heats Up", *Manufacturing Eng.*, (Jun. 1995) pp. 47–50.

Sprow, "Diamond Coatings: Ready to Rip?", *Manufacturing Eng*. (Feb. 1995) pp. 41–46.

Cook, "PCBNs Cut into Marketplace", *Canadian Machining and Metalworking*, vol. 88, No. 5 (Jun. 1993) pp. 13–14.

Murakawa et al., "The Synthesis of Cubic BN Films Using a Hot Cathode Plasma Discharge in a Parallel Magnetic Field", *Surface and Coatings Technology*, vol. 43–4 No. 1–3 (1990), pp. 128–136.

Murakawa et al., "Characteristics of c–BN Films Made by a Reactive Ion Plating Method", *New Diamond Science Technology Proceeding International Conference*, 2nd (1991) Edited by Russel Messier, Published by the Materials Research Society, pp. 1099–1104.x

BORON AND NITROGEN CONTAINING COATING AND METHOD FOR MAKING

This is a divisional of application Ser. No. 08/627,515, filed on Apr. 4, 1996 now U.S. Pat. No. 5,948,541.

BACKGROUND

Materials technology pursues the development of new and useful commercial materials including new hard materials. Such new hard materials include without limitation sintered ultra-fine powdered metals, metal matrix composites, heat treated steels (hardnesses of between about 50 to 60 Rockwell C), and high temperature alloys. These new materials have been developed to have extraordinary combinations of properties, such as, strength, toughness, stiffness or rigidity, hardness, and wear resistance, that makes them very suitable for uses in heavy industries, aerospace, transportation, and consumer products.

These extraordinary combinations of properties present challenges to the application of existing manufacturing and finishing processes to the new hard materials. Quite simply, these materials are very difficult and expensive to drill, cut, and form. For these new hard materials to realize the full extent of their commercial potential these challenges must be overcome. One can best address these challenges by the use of strong cutting tools that use a superhard material.

Superhard materials are significantly harder than any other compound and can be used to drill, cut, or form other materials. Such materials include diamond and cubic boron nitride (cBN). Diamond has a Knoop 100 hardness from about 75–100 gigapascal (GPa) and greater while cBN has a Knoop 100 hardness of about 45 GPa. Boron carbide ($B_4C$) and titanium diboride ($TiB_2$), the next hardest materials, each have a hardness of only about 30 GPa.

Diamond is found in nature and can be synthesized. Boron nitride, including cBN, is synthetic (see e.g., U.S. Pat. No. 2,947,617, in the name of Wentorf Jr.). Both synthetic diamond and synthetic cBN are produced and then sintered using high-temperature high-pressure (HT-HP) conditions (about 5 GPa and about 1500° C., see e.g., Y. Sheng & L. Ho-yi, "HIGH-PRESSURE SINTERING OF CUBIC BORON NITRIDE," P/M '78-SEMP 5, European Symposium on Powder Metallurgy, Stockholm, Sweden, June 1978, pp. 201–211.).

Presently, the two primary superhard commercial cutting tools comprise a polycrystalline diamond (PCD) cutting tool and a polycrystalline cubic boron nitride (PCBN) cutting tool. The PCD cutting tools have their typical application in the machining of hard non-ferrous alloys and difficult-to-cut composites. The PCBN cutting tools typically find application in the machining of hard ferrous materials. In the typical polycrystalline (PCD or PCBN) cutting tool, the cutting edge comprises a HT-HP superhard tip brazed onto a carbide blank. The tip comprises micrometer sized HT-HP diamond or HT-HP cubic boron nitride (cBN) crystals intergrown with a suitable binder and bonded onto a cemented carbide support. The HP-HT manufacturing process, as well as the finishing process for these tips, each entails high costs. The result is that PCD cutting tools and PCBN cutting tools are very expensive.

In addition to the expense, these cutting tools usually comprise a single tipped tool wherein the tip has relatively few styles with a planar geometry. Even though these cutting tools are expensive and come in relatively few styles, presently they are the best (and sometimes the only) cutting tool suitable to economically machine new hard difficult-to-cut materials.

Through the development of techniques for the low pressure deposition of diamond one is able to deposit conforming layers (or films) of diamond on cutting tool substrates without any significant limitation to the geometry of the cutting tool. While the diamond-coated cutting tools have advantages over the PCD cutting tools, there remain some significant limitations to the use of diamond coated cutting tools.

One primary limitation with diamond cutting tools (i.e., PCD and coated tools) is that diamond oxidizes into carbon dioxide and carbon monoxide during high temperature uses. Another principal limitation with diamond cutting tools is the high chemical reactivity of diamond (i.e., carbon) with certain materials. More specifically, materials that contain any one or more of iron, cobalt, or nickel dissolve the carbon atoms in diamond. These limitations reveal that while diamond-coated cutting tools provide certain advantages, there is a universe of materials that require a cutting tool with a superhard coating, but for which the use of a diamond-coated cutting tool is inappropriate.

It is very apparent that there is a need to provide a cutting tool with an adherent superhard coating that overcomes the above extant problems with diamond-coated cutting tools. More specifically, there is a need to provide a cutting tool with an adherent superhard coating wherein the coating does not oxidize during high temperature use. There is also a need to provide a cutting tool with an adherent superhard coating wherein the coating does not chemically react with workpiece materials that contain any one or more of iron, cobalt, or nickel.

One superhard material that passivates through the formation of protective oxides (i.e., boron oxide(s)) and therefore does not oxidize at high temperatures is boron nitride. In addition, boron nitride does not chemically react with any one or more of iron, nickel, or cobalt so that a workpiece which contains any one or more of these components does not dissolve the boron nitride. These advantageous properties of boron nitride exist with respect to various crystalline forms thereof such as, for example, amorphous boron nitride (aBN), cubic boron nitride (cBN), hexagonal boron nitride (hBN), and wurtzitic boron nitride (wBN), wherein cBN has especially good properties.

Although it is technically feasible to synthesize boron nitride, including cBN, from gaseous precursors, adhesion to a substrate continues to present technical challenges. For example, some cBN coatings fragment shortly after deposition (see e.g., W. Gissler, "PREPARATION AND CHARACTERIZATION OF CUBIC BORON NITRIDE AND METAL BORON NITRIDE FILMS," Surface and Interface Analysis, Vol. 22, 1994, pp. 139–148.) while others peel from the substrate upon exposure to air (see e.g., S. P. S. Arya & A. D'amico, "PREPARATION, PROPERTIES AND APPLICATIONS OF BORON NITRIDE FILMS," Thin Solid Films, Vol. 157, 1988, pp. 267–282.). Thermal expansion mismatch between the cBN coating and the substrate creates extreme residual stresses and might explain fragmentation. The formation a weak layer between the cBN coating and the substrate by the reaction of hygroscopic compounds with ambient moisture might explain peeling.

For the foregoing reasons, there is a need for a coating scheme comprising a boron and nitrogen containing coating, preferably one comprising boron nitride and more preferably one comprising cBN, that satisfactorily adheres to a substrate. Preferably, the coating scheme should be applicable to a substrate to form tooling, such as chip form machining inserts, for drilling, cutting, and/or forming the new hard difficult to cut materials. Thus a method for making an adherent boron and nitrogen containing coating, preferably one comprising boron nitride and more preferably one comprising cBN, is needed.

SUMMARY

The present invention satisfies the need for a coating scheme comprising a boron and nitrogen containing coating, preferably one comprising boron nitride and more preferably one comprising cBN, that satisfactorily adheres to a substrate. Further, the present invention satisfies the need for a coating scheme applicable to tooling, such as chip forming cutting inserts, for drilling, turning, milling, and/or forming the hard, difficult to cut materials.

The coating scheme of the present invention imparts wear or abrasion resistance, or both, to the substrate. The satisfactorily adherent coating scheme comprises a base layer, a first intermediate layer, a second intermediate layer and the boron and nitrogen containing layer.

The base layer comprises a metal that conditions the substrate to be compatible with the first intermediate layer. The conditioning may include gettering any atomic and/or radical species that is adsorbed to the substrate surface and which might otherwise be detrimental to the adhesion of any subsequent layers. In a preferred embodiment, the base layer comprises titanium or a comparable conditioning metal or alloy. In this regard, it is believed that the conditioning metal may comprise zirconium or hafnium, or even perhaps aluminum or magnesium.

The first and second intermediate layers transition from the base layer to the boron and nitrogen containing layer. In an embodiment of the present invention, at least one component (e.g., element) is common between the first intermediate layer and the second intermediate layer; at least one component is common between the second intermediate layer and the boron and nitrogen containing layer; and optionally, at least one component is common between the base layer and the first intermediate layer. For example, since the boron and nitrogen containing layer comprises boron and nitrogen, the second intermediate layer may comprise at least one of boron and nitrogen. Also, the first intermediate layer may comprise one of boron and nitrogen. However, if the second intermediate layer further comprises a third element, a fourth element, and so forth, then the first intermediate layer comprises at least one of boron, nitrogen, the third element, the fourth element, and so forth.

In another embodiment of the present invention, at least one component (e.g., element) is common among the first intermediate layer, the second intermediate layer, and the boron and nitrogen containing layer. For example, since the boron and nitrogen containing layer comprises both boron and nitrogen, the first and second intermediate layers comprise boron or nitrogen, or both.

In another embodiment of the present invention, at least one component (e.g., element) is common among the base layer, the first intermediate layer, and the second intermediate layer. For example, if the base layer comprises titanium, the first and second intermediate layers comprise titanium.

In another embodiment of the present invention, at least two components (e.g., elements) are common between the second intermediate layer and the boron and nitrogen containing layer. For example, since the boron and nitrogen containing layer comprises boron and nitrogen, the second intermediate layer comprises boron and nitrogen. In this embodiment, at least one component (e.g., element), optionally at least two components, may be common between the first intermediate layer and the second intermediate layer. Likewise, at least one component (e.g., element) may be common among the first intermediate layer, the second intermediate layer, and the boron and nitrogen containing layer or, alternatively, at least one component may be common among the base layer, the first intermediate layer, and the second intermediate layer.

In any of the previous embodiments of the present invention, the boron and nitrogen containing layer may comprise boron nitride including amorphous boron nitride (aBN), wurtzitic boron nitride (wBN), hexagonal boron nitride (hBN), cubic boron nitride (cBN), and combinations of the preceding. It is believed that the boron and nitrogen containing layer comprising cBN would be more preferred because cBN is a superhard material.

In a preferred embodiment, the coating scheme, when characterized using reflectance fourier transformed infrared spectroscopy (FTIR), has a small signal at about 770 $cm^{-1}$, a shoulder at about 1480 $cm^{-1}$, and a broad signal at about 1200 $cm^{-1}$.

The coating scheme of the present invention may be realized by providing a base layer to a substrate, a first intermediate layer on the base layer, a second intermediate layer on the first intermediate layer, and a boron and nitrogen containing layer, preferably boron nitride containing layer, and more preferably cBN containing layer on the second intermediate layer. Any technique or combination of techniques that result in the satisfactorily adherent coating scheme may be used. For example, chemical vapor deposition (CVD), physical vapor deposition (PVD), variants thereof, and combinations thereof may be used. In a preferred embodiment, an ion beam assisted PVD technique is used to form the boron and nitrogen containing layer.

An embodiment of the present invention is directed to tools including the coating scheme. For example, chip form machining inserts including the coating scheme satisfies the long felt need for a chemically inert wear and abrasive resistant coated tool for machining, among other things, ferrous alloys. The coating scheme may be used with cutting tools to machine materials that are compatible with diamond coated tooling and preferably materials that are incompatible with diamond coatings. The tools comprise the coating scheme on at least a portion a substrate material. The substrate material may comprise any material including, for example, metals, ceramics, polymers, composites of combinations thereof, and combinations thereof. Preferred substrate composite materials comprise cermets, preferably cemented carbides and more preferably cobalt cemented tungsten carbide, and ceramics.

The invention illustratively disclosed herein may suitably be practiced in the absence of any element, step, component or ingredient which is not specifically disclosed herein.

DRAWINGS

These and other features, aspects and advantages of the present invention will be better understood with reference to the following description, appended claims, and accompanying drawings where:

FIG. 1 depicts a cross sectional schematic of the coating scheme comprising a base layer 4, a first intermediate layer 6, a second intermediate layer 8, and a boron and nitrogen containing layer 10 provided to a substrate 2.;

DESCRIPTION

Figure 1:
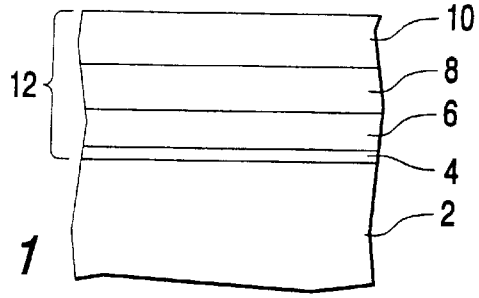

Depicted schematically in FIG. 1 is a coating scheme comprising a base layer 4, a first intermediate layer 6, a second intermediate layer 8, and a boron and nitrogen containing layer 10 on a substrate 2. The boron and nitrogen containing layer 10 preferably comprises boron nitride and more preferably cBN.

The base layer 4 comprises a metal that conditions the substrate to be compatible with subsequent layers such as the first intermediate layer. Although the base layer may be applied as a metal, its interaction with the substrate or adsorbed species on the substrate, or both, may convert the metal to a metal containing compound. In a preferred embodiment, the base layer comprises titanium. However, alloys of titanium or, for that matter, any alloy that produces a like substrate conditioning as is achieved with titanium may be used to form the base layer 4.

The first and second intermediate layers 6 & 8 transition from the base layer 4 to the boron and nitrogen containing layer 10. In an embodiment of the present invention, at least one component (e.g., element) is common between the first intermediate layer 6 and the second intermediate layer 8; at least one component is common between the second intermediate layer 8 and the boron and nitrogen containing layer 10; and optionally, at least one component is common between the base layer 4 and the first intermediate layer 6. For example, since the boron and nitrogen containing layer 10 comprises boron and nitrogen, the second intermediate layer 8 may comprise at least one of boron and nitrogen. Also, the first intermediate layer 6 may comprise one of boron and nitrogen. However, if the second intermediate layer 8 further comprises a third element, a fourth element, and so forth, then the first intermediate layer 6 may comprise at least one of boron, nitrogen, the third element, the fourth element, and so forth.

In another embodiment of the present invention, at least one component (e.g., element) is common among the first intermediate layer 6, the second intermediate layer 8, and the boron and nitrogen containing layer 10. For example, since the boron and nitrogen containing layer 10 comprises both boron and nitrogen, the first and second intermediate layers 6 & 8 comprise boron or nitrogen, or both.

In another embodiment of the present invention, at least one component (e.g., element) is common among the base layer 4, the first intermediate layer 6, and the second intermediate layer 8. For example, if the base layer 4 comprises titanium, the first and second intermediate layers 6 & 8 comprise titanium.

In yet another embodiment of the present invention, at least two components (e.g., elements) are common between the second intermediate layer 8 and the boron and nitrogen containing layer 10. For example, since the boron and nitrogen containing layer 10 comprises boron and nitrogen, the second intermediate layer 8 comprises boron and nitrogen. In this embodiment, at least one component (e.g., element), optionally at least two components, may be common between the first intermediate layer 6 and the second intermediate layer 8. Likewise, at least one component (e.g., element) may be common among the first intermediate layer 6, the second intermediate layer 8, and the boron and nitrogen containing layer 10 or, alternatively, at least one component may be common among the base layer 4, the first intermediate layer 6, and the second intermediate layer 8.

Coating schemes comprising (1) a base layer 4 comprising titanium; a first intermediate layer 6 comprising boron or carbon, preferably both; a second intermediate layer 8 comprising boron or carbon or nitrogen, preferably all three; and the boron and nitrogen containing layer 10 comprising boron nitride; or (2) the base layer 4 comprises titanium; the first intermediate layer 6 comprises boron or titanium, preferably both; the second intermediate layer 8 comprises boron or titanium or nitrogen, preferably all three; and the boron and nitrogen containing layer 10 comprises boron nitride are included in the above embodiments. The former, coating scheme (1), is a particularly preferred embodiment of the present invention.

When the first intermediate layer 6 comprises both boron and carbon (i.e., a boron and carbon containing layer), a B:C atomic ratio comprises about 2.7 to about 3.3. In other words, the atom percent (at %) boron in the boron and carbon containing layer comprises from about 73 to about 77 while the at % carbon substantially comprises the balance with an allowance for minor impurities.

When the second intermediate layer 8 comprises a boron, carbon, and nitrogen containing layer, a B:N ratio may comprise from about 29:71 to 54:46, preferably from about 29:71 to 41:59, and carbon from about 11 to 26 at %. In other words, the boron, carbon, and nitrogen containing layer may comprises a N:C atomic ratio from about 74:26 to 89:11 and an at % boron of about 29 to 54 atom percent.

The boron and nitrogen layer 10 may comprise a B:N atom ratio from about 0.6 to about 5.7. That is, boron of the boron and nitrogen containing layer may comprises from about 38 to about 85 at % while the nitrogen substantially comprises the balance with an allowance for minor impurities.

In any of the previous embodiments, the boron and nitrogen containing layer may comprise boron nitride including amorphous boron nitride (aBN), wurtzitic boron nitride (wBN), hexagonal boron nitride (hBN), cubic boron nitride (cBN), and combinations of the preceding. It is believed that the boron nitrogen containing layer comprising cBN would be more preferred because cBN is a superhard material.

The coating scheme, when characterized using reflectance fourier transformed infrared spectroscopy (FTIR), has a small signal at about 770 $cm^{-1}$, a shoulder at about 1480 $cm^{-1}$, and a broad signal at about 1200 $cm^{-1}$.

The thickness of each layer of the coating scheme is specified so that the combined thickness of the coating scheme is sufficient to provide an extended life to an uncoated substrate while avoiding levels of residual stress that might detrimentally affect the function of the coating scheme.

Tooling used for materials shaping, scratching, or indenting (e.g., drilling, cutting, and/or forming) represents one class of substrates that would benefit from the use of the coating scheme of the present invention. Coating scheme 12 satisfies the long felt need for a satisfactorily adherent, chemically inert, wear resistant, and abrasive resistant coating. These properties of coating scheme 12 satisfy the need for a superhard coating that can be applied to tooling to drill, cut, and/or form objects made from conventional materials as well as new hard materials.

When the coating scheme 12 is applied to tooling, it is believed that an effective coating scheme may have an overall thickness from about 1 micrometer ($\mu$m) to about 5 $\mu$m. It is also believed that an effective base layer 4 thickness may range from about 1 nanometer (nm) to about 1 $\mu$m or more, preferably being at least about 0.1 $\mu$m thick; an effective first intermediate layer 6 thickness may range from about 1 nm to about 1 $\mu$m or more, preferably being at least about 0.2 $\mu$m thick; an effective second intermediate layer 8 may range from about 1 nm to about 1 $\mu$m or more, preferably being at least about 0.2 $\mu$m thick; and an effective boron and nitrogen containing layer 10 may range from about 0.1 $\mu$m to about 2 $\mu$m or more, preferably being at least about 1 $\mu$m thick.

Coating scheme 12 is applied to at least a portion of a substrate material 2. The substrate 2 may comprise any material that possess the requisite physical and mechanical properties for the application and the ability to be conditioned to accept coating scheme 12. Such materials include metals, ceramics, polymers, composites of combinations thereof, and combinations thereof. Metals may be elements, alloys, and/or intermetallics. Metals include elements of IUPAC Groups 2–14. Ceramics include boride(s), carbide (s), nitride(s), oxide(s), their mixtures, their solid solutions, and combinations thereof. Polymers include organic and/or inorganic based polymers that retain desired mechanical and/or physical properties after the coating scheme has been applied to a portion thereof. Composites include metal matrix composite(s) (MMC), ceramic matrix composite(s) (CMC), polymer matrix composite(s) (PMC), and combinations thereof. While preferred composites include cermets, cemented carbide(s), and in particular cobalt cemented tungsten carbide, composites may include diamond tipped or diamond coated substrates, PCBN, or PCD.

Other typical materials include tungsten carbide-based material with other carbides (e.g. TaC, NbC, TiC, VC) present as simple carbides or in solid solution. The amount of cobalt may range between about 0.2 weight percent and about 20 weight percent, although the more typical range is between about 5 weight percent and about 16 weight percent. It should be appreciated that other binder materials may be appropriate for use. In addition to cobalt and cobalt alloys, suitable metallic binders include nickel, nickel alloys, iron, iron alloys, and any combination of the above materials (i.e., cobalt, cobalt alloys, nickel, nickel alloys, iron, and/or iron alloys). Further, it should be appreciated that a substrate with binder (cobalt) enrichment near the surface of the substrate as disclosed in U.S. Reissue Pat. No. 34,180 to Nemeth et al. for PREFERENTIALLY BINDER ENRICHED CEMENTED CARBIDE BODIES AND METHOD OF MANUFACTURE (assigned to the assignee of the present patent application) may be appropriate for treatment with the coating scheme.

It will be understood by a person skilled in the art the any substrate may be treated with the coating scheme to impart superior performance to the substrate relative to its uncoated counterpart.

Figure 2:
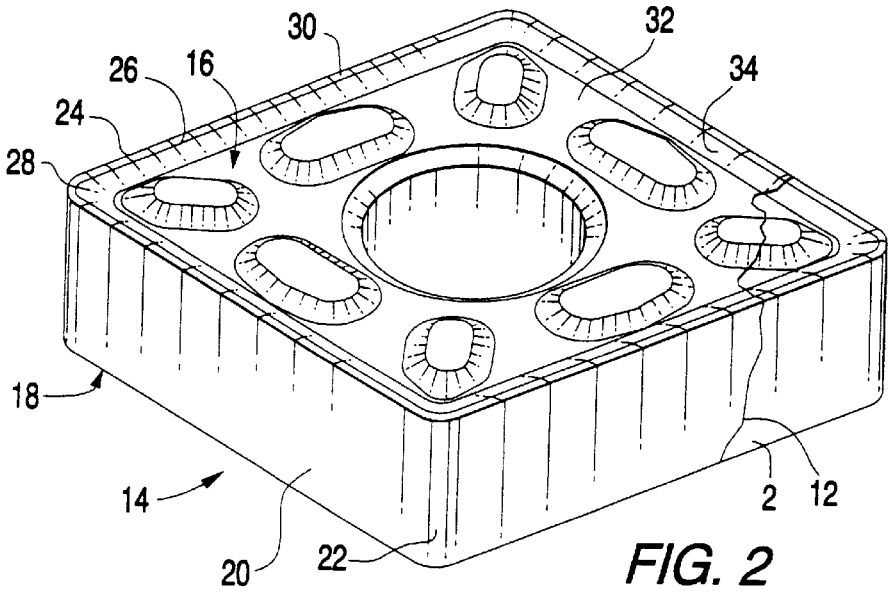
FIG. 2 shows a isometric schematic of a coating scheme on an indexable cutting tool.

In an embodiment of the present invention, the substrate comprises tooling such as for drilling, cutting, and/or forming materials. An example of such tooling includes an indexable cutting insert 14, as depicted in FIG. 2, comprising a polygonal body with top surface 16, bottom surface 18, and a peripheral wall with sides 20 and corners 22 extending from the top surface 16 to the bottom surface 18. At an intersection of the peripheral wall and the top surface 16 is a cutting edge 24. The top surface 16 comprises a land area 26 joining the cutting edge 24 and extending inwardly toward the center of the body. The land area 26 is comprised of corner portion land areas 28 and side portion land areas 30. The top surface 16 also comprises a floor 32 between the land area 26 and the center of the body, which is disposed at a lower elevation than the land area 26. The top surface 16 may further comprises sloping wall portions 34 inclined downwardly and inwardly from the land area 26 to the floor 32. A plateau or plateaus 36 may be disposed upon the floor 32 spaced apart from the sloping wall portions 34 and having sloped sides ascending from the floor 32. Furthermore, the bottom surface 18 of the body may have features similar to those described for the top surface 16. Regardless of its shape, the indexable cutting insert 14 is at least partially coated with the coating scheme 12 and preferably in portions that contact the material to be machined and/or that has been machined.

A cutting tool at least partially coated with the present coating scheme may be advantageously used in "HARD TURNING" or "HARD MACHINING" to displace grinding. Hard turning may include the process of cutting hardened alloys, including ferrous alloys such as steels, to final or finished form. The hardened alloy may be cut to accuracies of at least about ±0.0127 mm (0.0005 inch), preferably at least about ±0.0076 mm (0.0003 inch) and finishes better than about 20 micrometers rms on a lath or turning center. Cutting speeds, feeds, and depths of cut (DOC) may include any that are compatible with achieving the desired results. The cutting speed may range from about 50 to 300 meters/minute, preferably about 75 to 200 meters/minute, and more preferably about 80 to 150 meters/minute. Likewise, the feed may range from about 0.05 to 1 mm/revolution, preferably about 0.1 to 0.6 mm/revolution, and more preferably about 0.3 to 0.6 mm/revolution. Furthermore, the DOC may range from about 0.05 to 1 mm, preferably, about 0.1 to 0.25 mm, and more preferably about 0.1 to 0.3 mm. The above cutting parameters may be used either with or without a cutting or cooling fluid.

Any method that facilitates the formation of the coating scheme exhibiting at least wear resistance, abrasion resistance, and adherence is suitable. Such a method comprises providing a substrate 2 and, to at least a portion of the substrate, providing the base layer 4, the first intermediate layer 6, the second intermediate layer 8, and the boron and nitrogen containing layer 10. Preferably, the boron and nitrogen containing layer comprises boron nitride and more preferably cBN.

Although the examples of the present application are directed to PVD techniques for forming the coating scheme, the inventor contemplates that any technique or combination of techniques may be used in the method to provide the coating scheme including chemical vapor deposition (CVD), physical vapor deposition (PVD), variants of both, as well as combinations thereof.

Techniques representative of CVD cBN synthesis include, for example, those described in M. Murakawa & S. Watanabe, "THE SYNTHESIS OF CUBIC BN FILMS USING A HOT CATHODE PLASMA DISCHARGE IN A PARALLEL MAGNETIC FIELD," Coating Technology, Vol. 43, 1990, pp. 128–136; "Deposition of Cubic BN on Diamond Interlayers" NASA Tech Briefs, Vol. 18, No. 8 p. 53; Z. Song, F. Zhang, Y. Guo, & G. Chen, "TEXTURED GROWTH OF CUBIC BORON NITRIDE FILM ON NICKEL SUBSTRATES" Applied Physics Letter", Vol. 65, No. 21, 1994, pp. 2669–2671; and M. Kuhr, S. Reinke, & W. Kulisch, "DEPOSITION OF CUBIC BORON NITRIDE WITH AN INDUCTIVELY COUPLE PLASMA" Surface and Coating Technology, Vol. 74–75, 1995, pp. 806–812. Techniques representative of PVD cBN synthesis include, for example, those described in M. Mieno & T. Yosida, "PREPARATION OF CUBIC BORON NITRIDE FILMS BY SPUTTERING," Japanese Journal Of Applied Physics, Vol. 29, No. 7, July 1990, pp. L1175–L1177; D. J. Kester & R. Messier, "PHASE CONTROL OF CUBIC BORON NITRIDE THIN FILMS," J. Appl. Phys. Vol. 72, No. 2, July 1990; T. Wada & N. Yamashita, "FORMATION OF CBN FILMS BY ION BEAM ASSISTED DEPOSITION," J. Vac. Sci. Technol. A, Vol. 10, No. 3, May/June 1992; T. Ikeda, Y. Kawate, & Y. Hirai, "FORMATION OF CUBIC BORON NITRIDE FILMS BY ARC-LIKE PLASMA-ENHANCED ION PLATING METHOD," J. Vac. Sci. Technol. A, Vol. 8, No. 4, July/August 1990; and T. Ikeda, T. Satou, & H. Stoh, "FORMATION AND CHARACTERIZATION OF CUBIC BORON NITRIDE FILMS BY AN ARC-LIKE PLASMA-ENHANCED ION PLATING METHOD," Surface and Coating Technology, Vol. 50, 1991, pp. 33–39.

The present invention is illustrated by the following, which is provided to demonstrate and clarify various aspects of the present invention. The following should not be construed as limiting the scope of the claimed invention.

An AIRCO TEMESCAL FC 1800 fast cycle electron beam (e-beam) evaporator unit with a 20° C. water cooled high vacuum chamber equipped with a four-pocket e-beam gun and a radio frequency (RF) biased substrate holder was used. The unit also included a residual gas analyzer (IQ 200 from Inficon), a quartz lamp for chamber heating, an ion source (Mark I gridless end-Hall type from Commonwealth Scientific Corp., Alexandria, Va.), a faraday cup (interfaced to an IQ 6000 from Inficon), and filaments or an additional quartz lamp for supplemental substrate heating.

Figure 3:
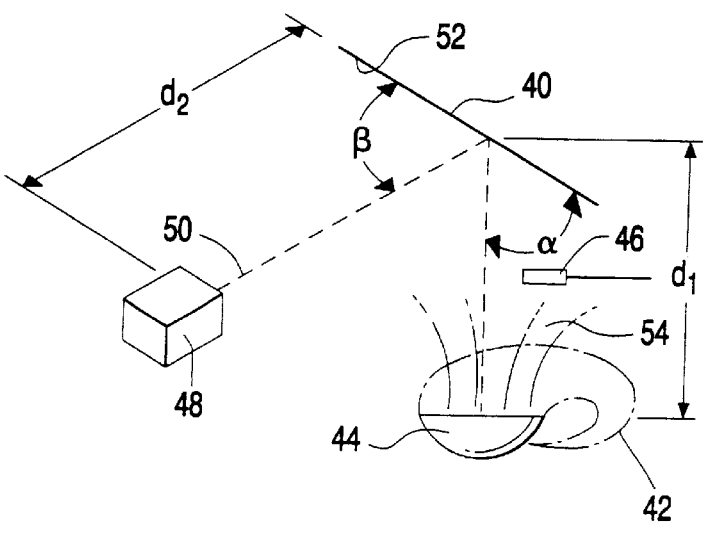
FIG. 3 shows a schematic of an arrangement of a substrate, an electron beam vapor source, and an ion source.

FIG. 3 depicts a substrate holder 40, a vapor source material 44, an electron beam 42 for creating a vapor 54 from the vapor source material 44, a faraday cup 46 (located on the periphery of the vapor 54 about 254 mm (10 inches) above the plane of the surface of the vapor source material 44 and about 165 nm (6.5 inches) from the center of the vapor source material 44) for measuring the evaporation rate of the material source 44, and an ion source 48. Angle α was measured between the plane of the substrate holder 40 and a line perpendicular to the surface of the source material 44 and substantially parallel to the line of sight from the source material 44. Angle β was measured between the plane of the substrate holder and the line of sight of the ion source. Three processes (Processes 1–3) are reported here for which Table I sets forth the geometric parameters.

The vapor source materials used in the three processes included titanium, boron carbide, and boron. The titanium and boron carbide each comprised 99.9 weight percent (wt %) commercially available materials, while the boron comprised 99.5 wt % commercially available material.

A typical run includes cleaning the substrate(s), depositing a base layer 4, depositing a first intermediate layer 6, depositing a second intermediate layer, and depositing a boron and nitrogen containing layer.

TABLE I

Geometric Parameters

| | Process 1 | Process 2 | Process 3 |
|---|---|---|---|
| angle α | —♣ | ~50° | ~47° |
| angle β | — | ~80° | ~65° |
| distance $d_1$ | ~444 mm | ~444 mm | ~444 mm |
| distance $d_2$ | ~140 mm | ~165 mm | ~90 mm |

♣"—" indicates that the parameter was not noted

TABLE II

Ion Beam Substrate Cleaning Parameters

| | Process 1 | Process 2 | Process 3 |
|---|---|---|---|
| ion beam energy | 150 eV | none | 150 eV |
| nitrogen flowrate | 10 sccm | none | 10 sccm |
| chamber pressure | $6.6 \times 10^{-5}$ Pa | none | $8.6 \times 10^{-5}$ Pa |
| substrate temperature | $T_1 \cong 424°$ C. | none | $T_1 \cong 459°$ C. $T_2 \cong 544°$ C. |
| duration | 24 minutes | none | 13 minutes |

The substrate cleaning may include using solvents and/or sand blasting and/or bombarding the substrates with an ion beam. When a nitrogen ion beam is used for cleaning, the nitrogen flowrate may comprise from about 3 to 10 standard cubic centimeters per minute (sccm), the chamber pressure may comprise from about $1\times10^{-6}$ to $5\times10^{-2}$ pascal (Pa), the substrate temperature may comprise from about 100 to 650° C., the ion beam energy may comprise from about 125 to 170 eV, and the duration may comprise from about 9 to 45 minutes. Table II sets forth the cleaning conditions for the three reported processes.

The deposition of the base layer 4 for the three processes comprised evaporating titanium. When titanium is deposited, the e-beam setting may comprise from about 5 to 11 percent, the chamber pressure may comprise from about $0.07\times10^{-4}$ to $10\times10^{-4}$ Pa, the substrate temperature may comprise from about 100 to 650° C., the evaporation rate may comprise from about 0.2 to 0.65 nm/s, and the duration may comprise from about 3 to 10 minutes. Table III sets forth the titanium deposition conditions for the three reported processes.

TABLE III

| | Titanium Deposition Parameters | | |
|---|---|---|---|
| | Process 1 | Process 2 | Process 3 |
| electron bean setting | 9% power | 8% power | 8–9% power |
| chamber pressure | 2.1 – 5.4 × $10^{-4}$ Pa | — | 1.3 – 8.6 × $10^{-5}$ Pa |
| evaporation rate | 0.5 nm/s | 0.57 nm/s | 0.63 nm/s |
| substrate temperature | — | $T_1 \cong 300°$ C., $T_2 \cong 410°$ C., & $T_3 \cong 4460°$ C. | $T_1 \cong 456°$ C. $T_2 \cong 537°$ C. |
| duration | 5 minutes | 3 minutes | 6 minutes |

The deposition of the first intermediate layer 6 for the three processes comprised depositing boron carbide. When boron carbide is deposited, the e-beam setting may comprise from about 6 to 10 percent, the chamber pressure may comprise from about $0.007\times10^{-3}$ to $6\times10^{-3}$ Pa, the substrate temperature may comprise from about 200 to 650° C., the evaporation rate may comprise from about 0.05 to 0.5 nm/s, and the duration may comprise from about 5 to 35 minutes. Table IV sets forth the boron carbide deposition conditions for the three reported processes.

TABLE IV

| | Boron Carbide Deposition Parameters | | |
|---|---|---|---|
| | Process 1 | Process 2 | Process 3 |
| electron bean setting | 8% power | 7–8% power | 6–8% power |
| chamber pressure | 9.3 × $10^{-5}$ Pa | 1.9 × $10^{-4}$ Pa | 4 × $10^{-5}$ Pa |
| evaporation rate | 0.25–0.35 nm/s | 0.2–0.24 nm/s | 0.3–0.5 nm/s |
| substrate temperature | $T_1 \cong 436°$ C. | $T_1 \cong 325°$ C., $T_2 \cong 434°$ C., & $T_3 \cong 488°$ C. | $T_1 \cong 462°$ C. $T_2 \cong 541°$ C. |
| duration | ~33 minutes | ~13 minutes | ~19 minutes |

The deposition of the second intermediate layer 8 for the three processes comprised contemporaneously nitriding and depositing boron carbide. When boron carbide is contemporaneously nitrided and deposited, the nitrogen ion beam energy may comprise from about 10 to 170 eV, the nitrogen flowrate may comprise about 10 sccm, the e-beam setting may comprise from about 6 to 10 percent, the chamber pressure may comprise from about $0.05\times10^{-2}$ to $2\times10^{-2}$ Pa, the substrate temperature may comprise from about 200 to 650° C., the evaporation rate may comprise from about 0.05 to 0.5 nm/s, and the duration may comprise from about 10 to 40 minutes. Table V sets forth the conditions for the contemporaneous nitriding and depositing of boron carbide for the three reported processes.

TABLE V

| | Contemporaneous Boron Carbide Deposition & Nitridation Parameters | | |
|---|---|---|---|
| | Process 1 | Process 2 | Process 3 |
| ion beam energy | 10 eV | 160 eV | 170 eV |
| nitrogen flowrate | 10 sccm | 10 sccm | 10 sccm |
| electron bean setting | 8% power | 8% power | 8% power |
| chamber pressure | — | 1.5 × $10^{-2}$ Pa | 2 × $10^{-3}$ Pa |
| evaporation rate | 0.25–0.35 nm/s | 0.24 nm/s | 0.4–0.5 nm/s |
| substrate temperature | $T_1 \cong 436°$ C. | $T_1 \cong 355°$ C., $T_2 \cong 454°$ C., & $T_3 \cong 506°$ C. | $T_1 \cong 470°$ C. $T_2 \cong 549°$ C. |
| duration | ~19 minutes | ~27 minutes | ~18 minutes |

The deposition of the boron and nitrogen containing layer 10 for the three processes comprised contemporaneously nitriding and depositing boron. When boron is contemporaneously nitrided and deposited, the ion beam energy may comprise from about 100 to 170 eV and greater, the nitrogen flowrate may comprise about 10 sccm, the e-beam setting may comprise from about 6 to 11 percent, the chamber pressure may comprise from about $0.01\times10^{-2}$ to $2\times10^{-2}$ Pa, the substrate temperature may comprise from about 200 to 650° C., the evaporation rate may comprise from about 0.1 to 0.35 nm/s, and the duration may comprise from about 10 to 70 minutes. Table VI sets forth the conditions for the contemporaneous nitriding and depositing of boron for the three reported processes.

TABLE VI

| | Contemporaneous Boron Deposition & Nitridation Parameters | | |
|---|---|---|---|
| | Process 1 | Process 2 | Process 3 |
| ion beam energy | 100 eV | 160 eV | 170 eV |
| nitrogen flowrate | 10 sccm | 10 sccm | 10 sccm |
| electron bean setting | 8% power | 7–8% power | 6–7% power |
| chamber pressure | — | 1.6 × $10^{-2}$ Pa | 2 × $10^{-3}$ Pa |
| evaporation rate | — | 0.15–0.2 nm/s | 0.1–0.2 nm/s |
| substrate temperature | $T_1 \cong 435°$ C. | $T_1 \cong 334°$ C., $T_2 \cong 435°$ C., & $T_3 \cong 493°$ C. | $T_1 \cong 463°$ C. $T_2 \cong 548°$ C. |
| duration | ~20 minutes | ~22 minutes | ~42 minutes |

Figure 4:
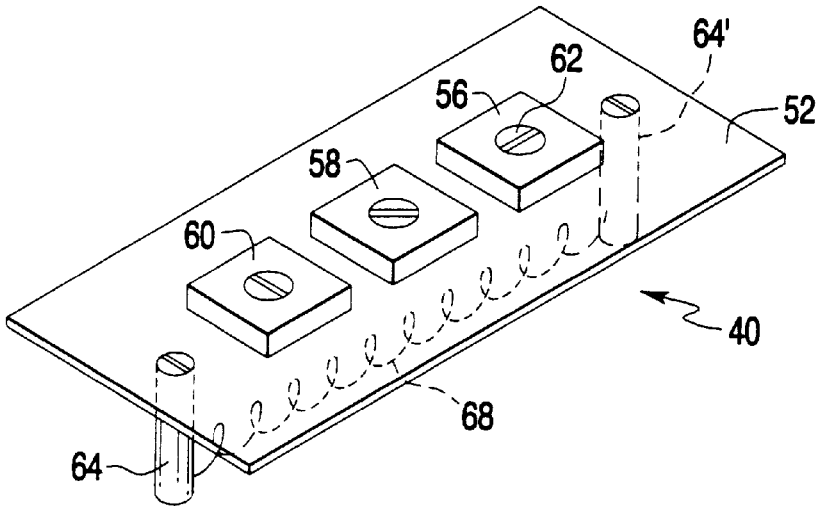
FIG. 4 shows a schematic of an arrangement of substrates and a heating element on a substrate holder for forming a coating scheme in accordance with a working example.

In Process 1 and referring to FIG. 4, four substrates were coated including silicon (p-type) wafers (not shown in FIG. 4), a SNGA432 SiAlON ceramic insert 56, and two SNMA432 cobalt cemented tungsten carbide inserts, one with an as received surface 58 and another with a sand blasted surfaces 60.

The SiAlON ceramic comprised a dual silicon aluminum oxynitride phase (α-SiAlON and β-SiAlON) ceramic made substantially by the methods of U.S. Pat. Ser. No. 4,563,433 and having a density of about 3.26 g/cm$^3$, a Knoop hardness 200 g of about 18 GPa, a fracture toughness ($K_{IC}$) of about 6.5 MPa·m$^{1/2}$, an elastic modulus of about 304 GPa, a shear modulus of about 119 GPa, a bulk modulus of about 227 GPa, a poisson's ratio of about 0.27, a tensile strength of about 450 MPa, a transverse rupture strength of about 745 MPa, and an ultimate compressive strength of about 3.75 GPa.

The cobalt cemented tungsten carbide (herein after Composition No. 1) comprised about 6 weight percent cobalt, about 0.4 weight percent chromium carbide, and the balance tungsten carbide. For Composition No. 1, the average grain size of the tungsten carbide is about 1–5 $\mu$m, the porosity is A04, B00, C00 (per the ASTM Designation B 276-86 entitled "Standard Test Method for Apparent Porosity in Cemented Carbides"), the density is about 14,900 kilograms per cubic meter (kg/m$^3$), the Rockwell A hardness is about 93, the magnetic saturation is about 90 percent wherein 100 percent is equal to about 202 microtesla cubic meter per kilogram-cobalt ($\mu$Tm$^3$/kg) (about 160 gauss cubic centimeter per gram-cobalt (gauss-cm$^3$/gm)), the coercive force is about 285 oersteds, and the transverse rupture strength is about 3.11 gigapascal (GPa).

The inserts were secured to the substrate holder 40 with a screw 62; however, any suitable means may be used. Wafers of silicon substrate material were secured to the substrate holder 40 by clamping the wafers between the ceramic substrate 56 and the substrate holder 40. A thermocouple was secured between substrate 58 and the substrate holder 40 to monitor the substrate temperatures during the coating process.

Figure 7:
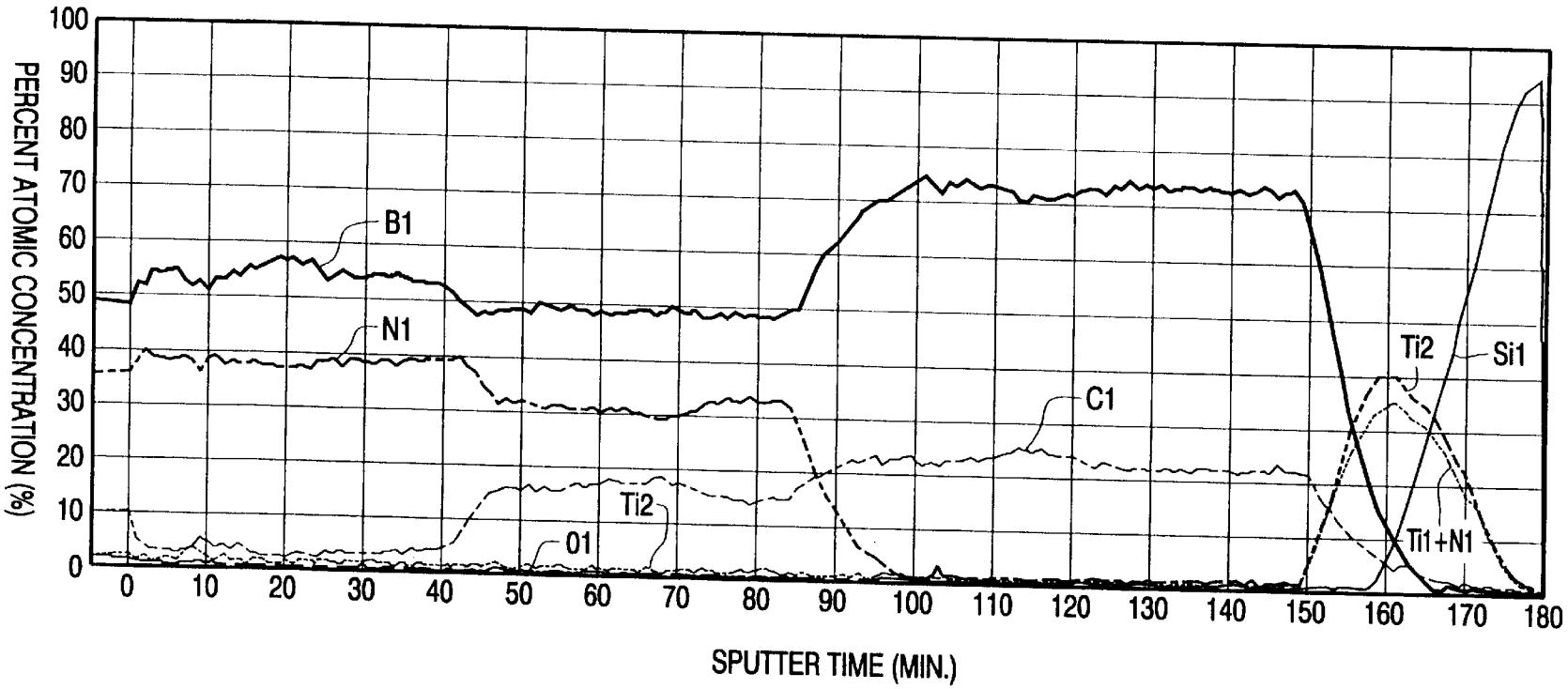
FIG. 7 shows the atomic concentration of boron (B1), nitrogen (N1), oxygen (O1), carbon (C1), titanium (Ti2 and Ti1+N1), and silicon (Si1) as a function of sputtering time in a coating scheme formed on a silicon wafer in Process 1 of the working examples.

The coating on one silicon wafer from Process 1 was analyzed using auger spectroscopy and depth profiling. As shown in FIG. 7, the atomic concentration of boron (B1 based on the KLL transition for boron), nitrogen (N1 based on the KLL transition for nitrogen), oxygen (O1 based on the KLL transition for oxygen), carbon (C1 based on the KLL transition for carbon), titanium (Ti2 based on the LMM transition for titanium), silicon (Si1 based on the LMM transition for silicon) as a function of sputtering time was determined. The sputtered area was set to about 3 square millimeters (mm$^2$) while the sputter rate was calibrated using tantalum oxide ($Ta_2O_3$) to about 14.2 nanometers per minute (nm/min.). The atomic concentration results, the sputter time and the sputter rate may be used to determine the atomic concentration as a function of depth. FIG. 7 demonstrates an embodiment of a coating scheme of the present invention. A boron and nitrogen containing layer (sputter time ~0–40 minutes in FIG. 7); followed by a boron, carbon, and nitrogen containing layer (sputter time ~50–80 minutes in FIG. 7); a boron and carbon containing layer (sputter time ~100–150 minutes in FIG. 7); and a titanium containing layer (sputter time ~160–180 minutes in FIG. 7). It should be noted that Ti2 and Ti1+N1 were used to identify the titanium containing layer. The Ti1 and N1 signals are coincidental: however, the titanium containing layer may comprise titanium or titanium nitride or both. Analysis results of the depth profiling data showed that: the boron and nitrogen containing layer comprised between about 56–61 atom percent boron and between about 39–44 atom percent nitrogen; the boron, carbon, and nitrogen containing layer comprised between about 48–52 atom percent boron, between about 29–34 atom percent nitrogen, and between about 13–18 atom percent carbon; and the boron and carbon containing layer comprised between about 72–77 atom percent boron and between about 22–28 atom percent carbon.

The coated SNGA432 SiAlON ceramic insert 56 of Process 1 was tested in the hard machining of D3 tool steel (55≦HRc≦60) for about 15 seconds. The test was run dry (i.e., without a cutting fluid) using a speed of about 150 SFM, a feed of 0.0045 ipr, a depth of cut of 0.02", and a lead angle of −5°. Additionally, an uncoated SNGA432 SiAlON ceramic insert was also tested for comparison. Primarily, the results indicate that the coating was satisfactorily adherent to the ceramic substrate and remained so under the rigorous conditions of the test.

Figure 5:
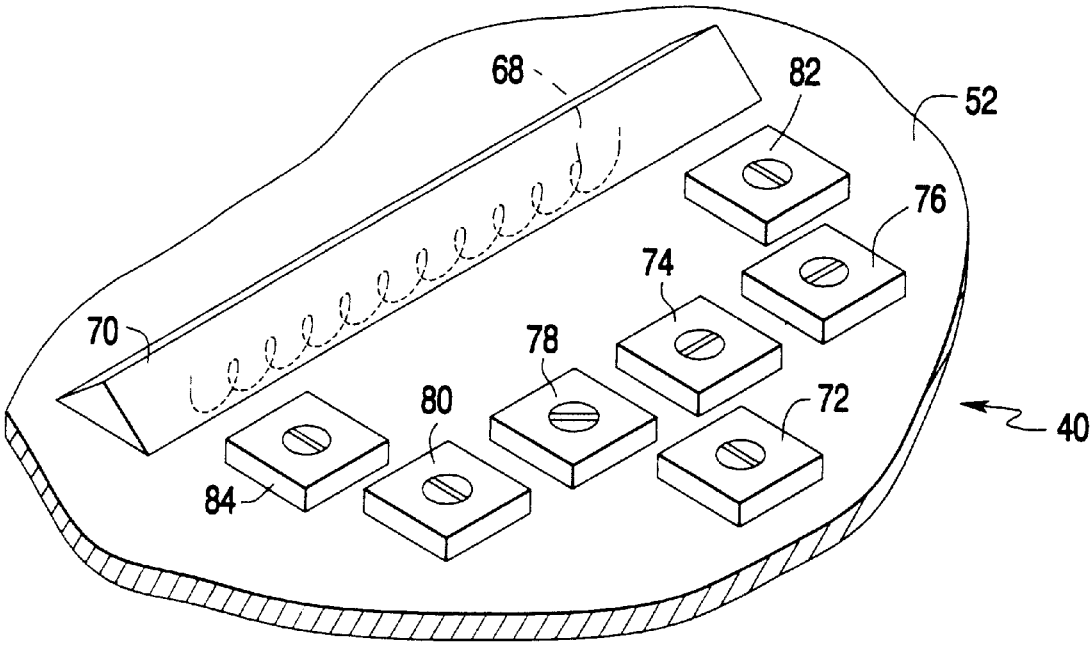
FIG. 5 shows a schematic of an arrangement of substrates and a heating element on a substrate holder for forming a coating scheme in accordance with a working example.

In Process 2 and referring to FIG. 5, seven substrates were coated including silicon (p-type) (not shown in FIG. 5), one SNGA432 SiAlON ceramic insert 76, and six CNMA432 Composition No. 1 cobalt cemented tungsten carbide inserts with as received surfaces 72, 74, 78, 80, 82, and 84. Three thermocouples were positioned substantially in the plane of the substrate holder 40 to monitor the substrate temperatures throughout the coating process. The first thermocouple was secured between Sample 76 and the substrate holder 40. The temperature measured with the first thermocouple is designate $T_1$ in Tables. The second thermocouple was secured between a mock substrate (not shown in FIG. 5) the substrate holder 40 next to substrate 82 and in line with substrate 82 and substrate 84. The temperature measured with the second thermocouple is designate $T_2$ in the Tables. The third thermocouple was secured to the top of the mock substrate next to substrate 82 and in line with substrate 82 and substrate 84. The temperature measured with the third thermocouple is designate $T_3$ in the Tables. The relative position of the substrates on the substrate holder and the heating element 68 created a temperature gradient among the three rows of substrates.

As the data presented in Tables suggest, the substrates from the Process 2 experienced different temperatures depending on the sample location relative to the resistance heater. In view of these differences, one might expect difference among the composition of the resultant coatings. To evaluate any differences, auger spectroscopy and depth profiling was performed on the coated Composition No. 1 inserts 72, 76, and 84.

Figure 8:
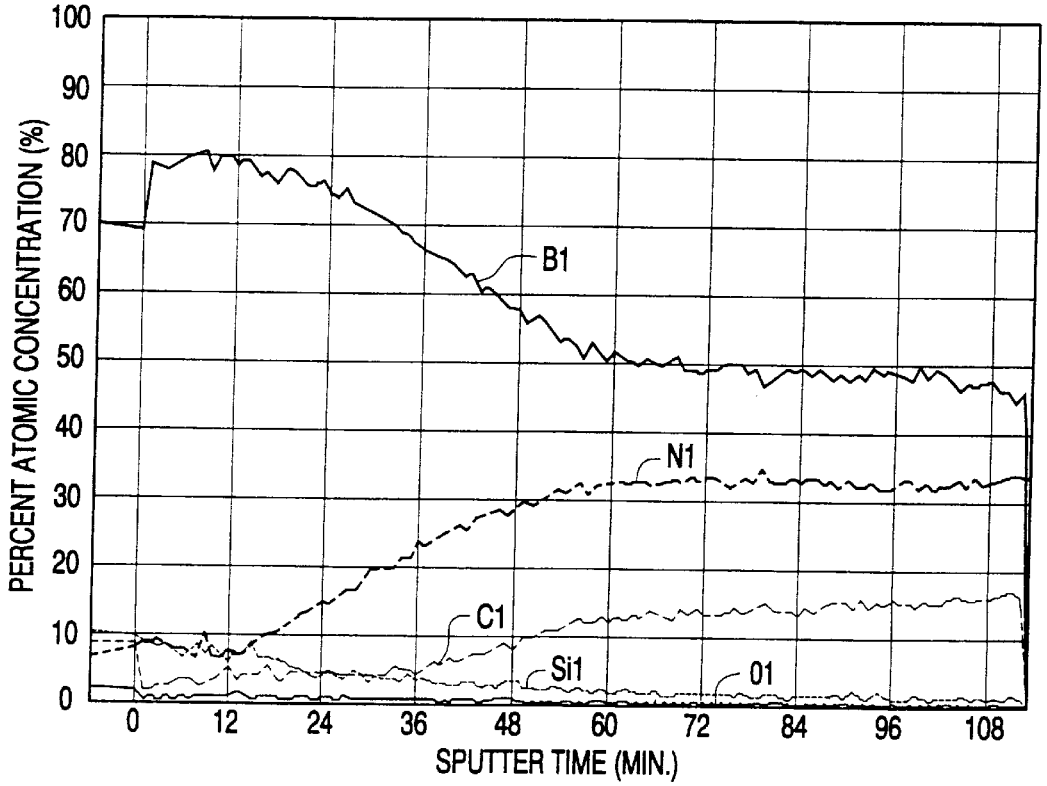
FIG. 8 shows the atomic concentration of boron (B1), nitrogen (N1), carbon (C1), oxygen (O1), and silicon (Si1) as a function of sputtering time in a boron and nitrogen containing layer and a second intermediate layer of a coating scheme formed on a cemented carbide substrate in Process 2 of the working examples.
Figure 9:
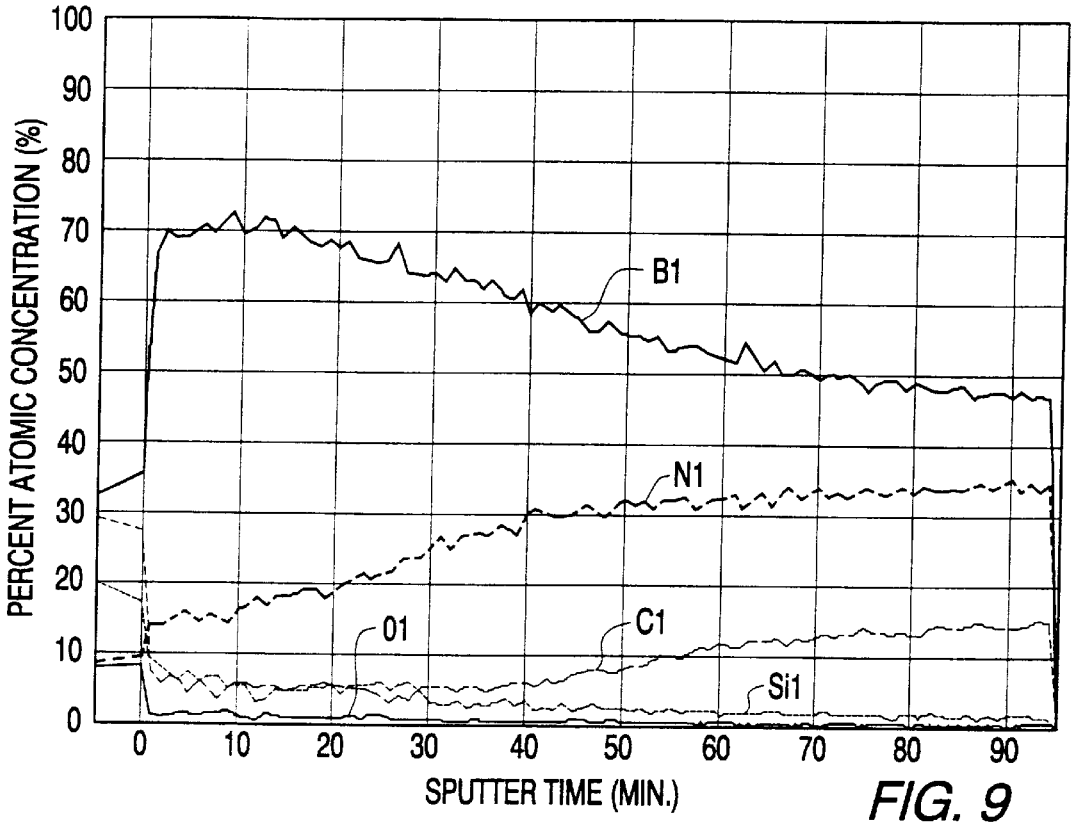
FIG. 9 shows the atomic concentration of boron (B1), nitrogen (N1), carbon (C1), oxygen (O1), and silicon (Si1) as a function of sputtering time in a boron and nitrogen containing layer and a second intermediate layer of a coating scheme formed on a cemented carbide substrate in Process 2 of the working examples.
Figure 10:
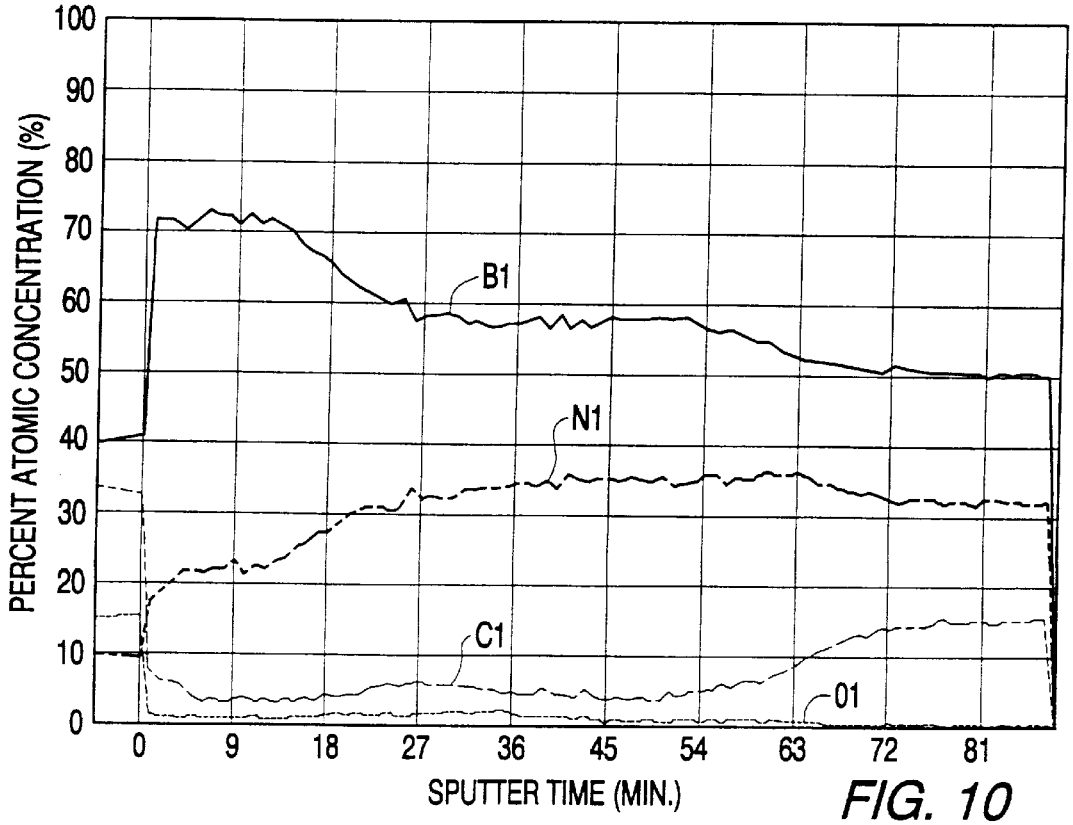
FIG. 10 shows the atomic concentration of boron (B1), nitrogen (N1), carbon (C1), and oxygen (O1) as a function of sputtering time in a boron and nitrogen containing layer and a second intermediate layer of a coating scheme formed on a cemented carbide substrate in Process 2 of the working examples.

The results of the auger spectroscopy analyses are presented in FIGS. 8, 9, and 10 respectively. The depth profiling was limited to the boron and nitrogen containing layer and the boron, carbon, and nitrogen containing layer. For coated substrate 72, the boron and nitrogen containing layer comprised between about 65–85 atom percent boron and between about 15–35 atom percent nitrogen; the boron, carbon, and nitrogen containing layer comprised between about 30–34 atom percent boron, between about 44–48 atom percent nitrogen, and between about 18–24 atom percent carbon.

For coated substrate 76, the boron and nitrogen containing layer comprised between about 42–66 atom percent boron, between about 28–47 atom percent nitrogen, and between about 5–11 atom percent carbon; and the boron, carbon, and nitrogen containing layer comprised between about 31–39 atom percent boron, between about 46–48 atom percent nitrogen, and between about 13–20 atom percent carbon.

For coated substrate 84, the boron and nitrogen containing layer comprised between about 37–76 atom percent boron, between about 22–51 atom percent nitrogen, and between about 0–12 atom percent carbon; and the boron, carbon, and nitrogen containing layer comprised between about 31–38 atom percent boron, between about 42–51 atom percent nitrogen, and between about 11–22 atom percent carbon.

Figure 11:
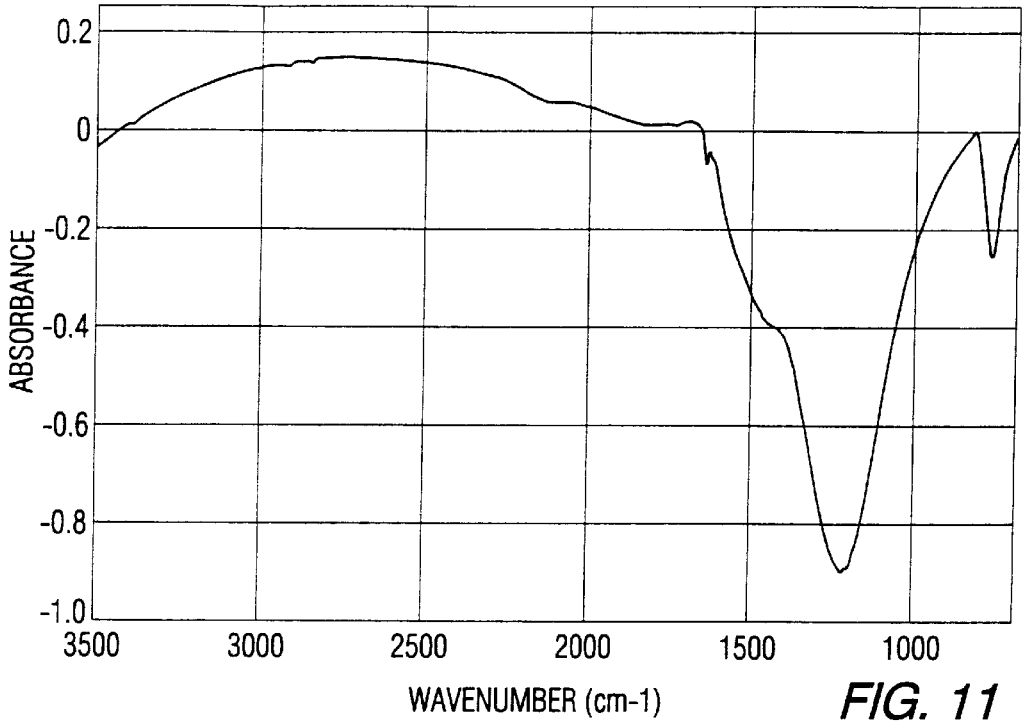
FIG. 11 shows the reflectance fourier transformed inferred spectrum of a coating scheme formed on a cemented carbide substrate in Process 2 of the working examples.
Figure 12:
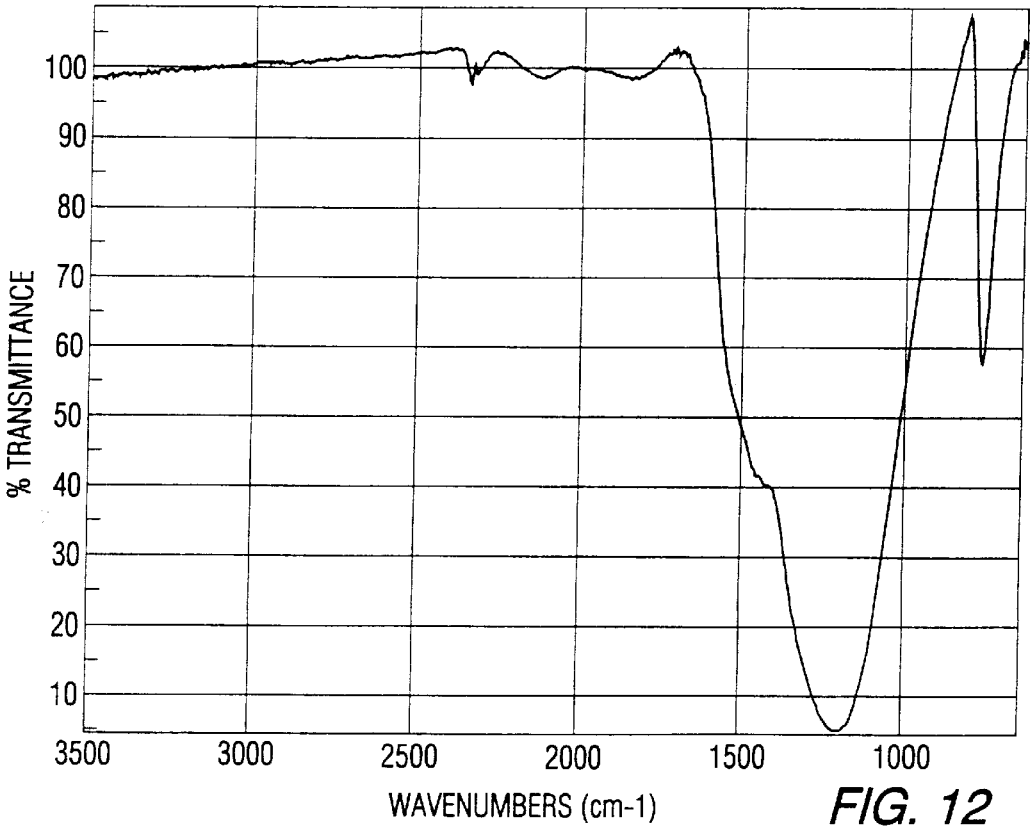
FIG. 12 shows the reflectance fourier transformed inferred spectrum of a coating scheme formed on a cemented carbide substrate in Process 2 of the working examples.

Additionally, fourier transformed infrared spectroscopy (FTIR) was performed on coated substrates 78, 80, and 82. The reflectance FTIR spectrum for coated substrates 78 and 80 are presented in FIGS. 11 and 12, respectively. These spectrum comprise a shoulder at about 1480 cm$^{-1}$, a broad peak at about 1200 cm$^{-1}$, and a peak at about 770 cm$^{-1}$. The spectrum from coated substrate 82 exhibited similar characteristics, in particular the broad peak at about 1200 $cm^{-1}$. The reflectance spectrum of FIG. 12 was generated using a Spectra Tech IR-Plan Microscope attached to a Nicolet MAGNA IR 550 FTIR spectrometer. The system included an infrared source, a MCT/B detector, and a KBr beamsplitter. The data from the analysis was collected in the reflectance mode with a gold mirror background using 128 scans with a spectral resolution of about 4 $cm^{-1}$, no correction, and a Happ-Genzel apodization. The final format of the reflectance FTIR spectrum was presented as transmittance.

Measured Knoop hardness (using a 25 gram load) of coated substrate 82 ranged from about 30 GPa to about 41 GPa with an average of about 34 GPa. Likewise, measured Vicker's hardness (using a 25 gram load) of coated substrate 82 ranged from about 21 GPa to about 32 GPa with an average of about 25 GPa.

The sufficiency of the adhesion of the coating to substrates exposed in Process 2 was checked by determining the critical load for the first indication of flaking using a Rockwell A Brale indentor substantially as described in P. C. Jindal, D. T. Quinto, & G. J. Wolfe, "ADHESION MEASUREMENTS OF CHEMICALLY VAPOR DEPOSITION AND PHYSICALLY VAPOR DEPOSITED HARD COATINGS ON WC-CO SUBSTRATES," Thin Solid Films Vol. 154, pp. 361–375, 1987. The coatings consistently withstood a 60 kilogram (kg) load while some coatings first exhibited flaking with a 100 kg load.

Coated CNMA432 substrate 82 was used in a hard machining of D3 tool steel ($55 \leqq HR_C \leqq 60$) for 20 seconds test. The coating thickness on substrate 82 measured about 1.2 to about 1.4 $\mu$m (determined from a Calotte Scar measurement). The test was run dry (i.e., without cutting a fluid) at a speed of 150 SFM, a feed of 0.0045 ipr, a depth of cut of 0.02", and a lead angle of −5°. Additionally, an uncoated CNMA432 substrate was also tested for comparison. Primarily, the results indicate that the coating was satisfactorily adherent to the cemented tungsten carbide substrate and remained so under the rigorous conditions of the test.

Figure 6:
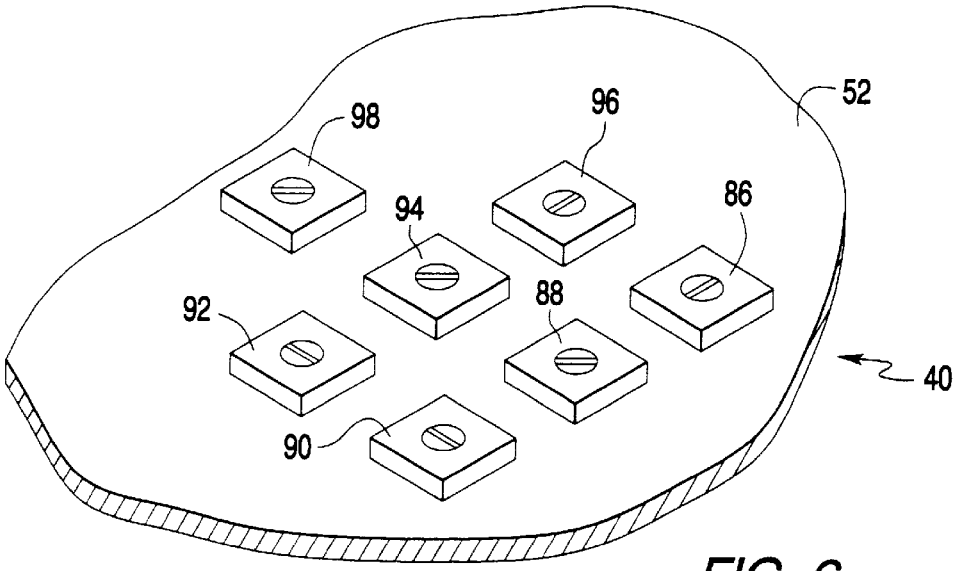
FIG. 6 shows a schematic of an arrangement of substrates on a substrate holder for forming a coating scheme in accordance with a working example.

In Process 3 and referring to FIG. 6, seven substrates were coated including one SNGA432 SiAlON ceramic insert 86, three SNMA432 composition No. 1 cobalt cemented tungsten carbide inserts 88, 94, & 98 and three SNMA432 Composition No. 2 cobalt cemented tungsten carbide inserts 90, 92,. & 96.

Composition No. 2 comprises about 5.7 weight percent cobalt, 2 weight percent TaC, and the balance tungsten carbide. For Composition No. 2, the average grain size of the tungsten carbide is about 1–4 $\mu$m, the porosity is A06, B00, C00 (per the ASTM Designation B 276-86), the density is about 14,950 $kg/m^3$, the Rockwell A hardness is about 92.7, the magnetic saturation is about 92 percent, the coercive force is about 265 oersteds, and the transverse rupture strength is about 1.97 gigapascal (GPa).

The inserts were secured to the substrate holder 40 with screws 62. Two thermocouples were positioned substantially in the plane of the substrate holder 40 to monitor the substrate temperatures throughout the coating run. The first thermocouple was secured between substrate 92 and the substrate holder 40. The temperature measured with the first thermocouple is designated $T_1$ in the Tables. The second thermocouple was secured between substrate 92 and substrate holder 40. The temperature measured with the second thermocouple is designated $T_2$ in the Tables.

All patents and other documents identified in this application are hereby incorporated by reference herein.

The previously described versions of the present invention have many advantages, including allowing the use of a boron and nitrogen, preferably cBN, containing coatings with cuttings tools such as machining inserts for turning and milling, drills, end mills, reamers, and other indexable as well as nonindexable tooling. Furthermore, this tooling may be used to machine metals, ceramics, polymers, composites of combinations thereof, and combinations thereof. In particular this tooling may be used to cut, drill, and form materials that are incompatible with diamond such as, for example, iron base alloys, nickel base alloys, cobalt base alloys, titanium base alloys, hardened steels, hard cast iron, soft cast iron, and sintered irons.

Although the present invention has been described in considerable detail with reference to certain preferred versions thereof, other versions are possible. Examples include: coatings in wear parts for such applications as TAB bonders for electronic applications, dies, and punches; coatings on carbide tips in mining tools, construction tools, earth drilling tools, and rock drilling tools; thin coatings on sliders used in magneto-resistive (MR) computer disk drives; and transparent coatings on bar scanner code scanner windows. Therefore, the spirit and scope of the appended claims should not be limited to the description of the preferred versions contained herein.

What is claimed is:

1. A method of making a cutting tool comprising a substrate and a coating on at least a portion of the substrate, the method comprising the steps of:

(a) providing a substrate, (b) forming a base layer on the substrate;

(c) forming a boron and carbon containing layer on the base layer;

(d) forming a boron, nitrogen, and carbon containing layer on the boron and carbon containing layer; and (e) forming a boron and nitrogen containing layer on the boron, nitrogen, and carbon containing layer.

2. A method according to claim 1, wherein the boron and nitrogen containing layer comprises about 38 to 85 atom percent boron.

3. A method according to claim 1, wherein the boron and nitrogen containing layer comprises about 15 to 62 atom percent nitrogen.

4. A method according to claim 1, wherein the boron and nitrogen containing layer comprises boron nitride.

5. A method according to claim 1, wherein the a boron and nitrogen containing layer comprises cubic boron nitride.

6. A method according to claim 1, wherein a reflectance FTIR spectrum of the coating comprises a broad peak at about 1200 $cm^{-1}$.

7. A method according to claim 1, wherein the boron, carbon, and nitrogen containing layer comprises a B:N ratio from about 29:71 to 54:46 and a carbon content of about 11 to 26 atom percent.

8. A method according to claim 1, wherein the boron, carbon, and nitrogen containing layer comprises a B:N ratio from about 29:71 to 41:59 and a carbon content of about 11 to 26 atom percent.

9. A method according to claim 1, wherein the boron, carbon, and nitrogen containing layer comprises a N:C ratio from about 74:26 to 89:11 and a boron content of about 29 to 54 atom percent.

10. A method according to claim 1, wherein the substrate comprises at least one of a cermet, a cemented carbide, a ceramic, and a metal.

11. A method according to claim 1 wherein the boron and nitrogen containing layer is deposited using one of a chemical vapor deposition technique and a physical vapor deposition technique.

12. A method according to claim 1 wherein the boron and nitrogen containing layer is deposited using an ion beam assisted PVD technique.

13. A method according to claim 12 wherein the ion beam comprises a nitrogen ion beam.

14. A method of making a cutting tool comprising a substrate and a coating on at least a portion of the substrate, the method comprising:

(a) providing a substrate, the substrate comprising a cobalt cemented tungsten carbide comprising about 0.2 weight percent cobalt to about 20 weight percent cobalt;

(b) forming a base layer on the substrate;

(c) forming a boron and carbon containing layer on the base layer;

(d) forming a boron, nitrogen, and carbon containing layer on the boron and carbon containing layer; and (e) forming a boron and nitrogen containing layer on the boron, nitrogen, and carbon containing layer.

15. A method according to claim 14, wherein the boron and nitrogen containing layer comprises about 38 to 85 atom percent boron.

16. A method according to claim 14, wherein the boron and nitrogen containing layer comprises about 15 to 62 atom percent nitrogen.

17. A method according to claim 14, wherein the boron and nitrogen containing layer comprises boron nitride.

18. A method according to claim 14, wherein the boron and nitrogen containing layer comprises cubic boron nitride.

19. A method according to claim 14, wherein a reflectance FTIR spectrum of the coating comprises a broad peak at about 1200 $cm^{-1}$.

20. A method according to claim 14, wherein the boron, carbon, and nitrogen containing layer comprises a B:N ratio from about 29:71 to 54:46 and a carbon content of about 11 to 26 atom percent.

21. A method according to claim 14, wherein the boron, carbon, and nitrogen containing layer comprises a B:N ratio from about 29:71 to 41:59 and a carbon content of about 11 to 26 atom percent.

22. A method according to claim 14, wherein the boron, carbon, and nitrogen containing layer comprises a N:C ratio from about 74:26 to 89:11 and a boron content of about 29 to 54 atom percent.

23. A method according to claim 14, wherein the cobalt cemented tungsten carbide comprises about 5 weight percent to about 16 weight percent cobalt.

24. A method according to claim 14 wherein the boron and nitrogen containing layer is deposited using one of a chemical vapor deposition technique and a physical vapor deposition technique.

25. A method according to claim 14 wherein the boron and nitrogen containing layer is deposited using an ion beam assisted PVD technique.

26. A method according to claim 25 wherein the ion beam comprises a nitrogen ion beam.

27. A method according to claim 14 wherein the boron and nitrogen containing layer comprises boron nitride and is deposited using an ion beam assisted PVD technique.

28. A method of making a cutting tool comprising a substrate and a coating on at least a portion of the substrate, the method comprising:

(a) providing a substrate, the substrate comprising at least one of a cermet, a cemented cubide, a ceramic and a metal (b) forming a base layer on the substrate; the base layer comprising at least one of titanium, zirconium, hafnium, aluminum and magnesium;

(c) forming a boron and carbon containing layer on the base layer;

(d) forming a boron, nitrogen, and carbon containing layer on the boron and carbon containing layer; and (e) forming a boron and nitrogen containing layer on the boron, nitrogen, and carbon containing layer.

29. The method according to claim 28, wherein the boron and nitrogen containing layer comprises about 38 to 85 atom percent boron.

30. The method according to claim 28, wherein the boron and nitrogen containing layer comprises about 15 to 62 atom percent nitrogen.

31. The method according to claim 28, wherein the boron and nitrogen containing layer comprises boron nitride.

32. The method according to claim 28, wherein the boron and nitrogen containing layer comprises cubic boron nitride.

33. The method according to claim 28, wherein a reflectance FTIR spectrum of the coating comprises a broad peak at about 1200 $cm^{-1}$.

34. The method according to claim 28, wherein the boron, carbon, and nitrogen containing layer comprises a B:N ratio from about 29:71 to 54:46 and a carbon content of about 11 to 26 atom percent.

35. The method according to claim 28, wherein the boron, carbon, and nitrogen containing layer comprises a B:N ratio from about 29:71 to 41:59 and a carbon content of about 11 to 26 atom percent.

36. The method according to claim 28, wherein the boron, carbon, and nitrogen containing layer comprises a N:C ratio from about 74:26 to 89:11 and a boron content of about 29 to 54 atom percent.

37. A method according to claim 28, wherein the base layer comprise titanium.

38. A method according to claim 28 wherein the boron and nitrogen containing layer is deposited using one of a chemical vapor deposition technique and a physical vapor deposition technique.

39. A method according to claim 28 wherein the boron and nitrogen containing layer is deposited using an ion beam assisted PVD technique.

40. A method according to claim 39 wherein the ion beam comprises a nitrogen ion beam.

* * * * *